US007461415B2

(12) United States Patent
Buzzetti et al.

(10) Patent No.: US 7,461,415 B2
(45) Date of Patent: Dec. 9, 2008

(54) METHOD AND APPARATUS FOR AUTOMATICALLY LIFTING A COVER

(76) Inventors: Mike Buzzetti, 880 Tracy Way, Templeton, CA (US) 93465; Zachery C. Mansfield, 1838 Cottonwood Cir., Paso Robles, CA (US) 93446; Michael J. Mowrey, 1808 Ramboulet, Paso Robles, CA (US) 93446

( * ) Notice: Subject to any disclaimer, the term of this patent is extended or adjusted under 35 U.S.C. 154(b) by 0 days.

(21) Appl. No.: 11/371,635

(22) Filed: Mar. 8, 2006

(65) Prior Publication Data

US 2007/0209103 A1 Sep. 13, 2007

(51) Int. Cl.
*E04H 4/00* (2006.01)

(52) U.S. Cl. ..... 4/498; 4/500

(58) Field of Classification Search ..... 4/498–503, 4/246.1–246.5; 318/280, 282, 283
See application file for complete search history.

(56) References Cited

U.S. PATENT DOCUMENTS 3,366,855 A * 1/1968 Huber et al. ..... 318/16
5,950,252 A 9/1999 Fettes
6,032,305 A 3/2000 Tedrick
6,442,799 B1 9/2002 Duarte et al.
6,795,984 B1 9/2004 Brady
6,802,086 B1 10/2004 Hudzinski
7,308,722 B2 * 12/2007 Koren ..... 4/498
2004/0139540 A1 7/2004 Lahay
2004/0143895 A1 7/2004 Loyd et al.
2005/0262228 A1 11/2005 Holloway et al.
2006/0053543 A1 * 3/2006 Vargas et al. ..... 4/498
2006/0162060 A1 7/2006 Coleman et al.
2007/0107118 A1 * 5/2007 Tudor ..... 4/498

* cited by examiner

*Primary Examiner*—Khoa D Huynh
(74) *Attorney, Agent, or Firm*—Philip A Steiner, Esq.

(57) ABSTRACT

An apparatus for lifting a cover from a spa or other housing includes a frame member having one end that is pivotally attached to the exterior of the housing. Another end of the frame member is pivotally attached to the cover. A motor is likewise attached to the exterior of the housing and is pivotally coupled to the frame member. The motor causes the frame member to rotate thereby lifting the cover off of the housing.

17 Claims, 3 Drawing Sheets

METHOD AND APPARATUS FOR AUTOMATICALLY LIFTING A COVER

FIELD OF THE INVENTION

This relates to spas and other housings, and more specifically, to methods and apparatuses for automatically lifting a cover off of such housings.

BACKGROUND

Spas are popular fixtures that are used in many homes and hotels. They include a large tub or small pool full of heated water and used for soaking and relaxation. Many spas further include water jets for massage purposes. Spas usually have several independent water circuits with one providing heating and filtration and the others driving the hydrotherapy jets.

The spa tubs are usually relatively shallow and manufactured from fiberglass-reinforced plastic that is formed into shapes that provide a variety of seating arrangements within the tub. Each seat is usually equipped with hydrotherapy jets that allow a forceful flow of water to be directed at various parts of the body. The water flow may be aerated for additional effect, and some or all of the jets may also automatically move or rotate, causing the changing pressure of the water on the body to provide a massage-like effect.

Spas are frequently located outdoors. The spa tubs may be free-standing or recessed within a surrounding deck or ground. If free-standing, they are usually entered by climbing a short staircase of one or two steps and then stepping over the side of the tub onto one of the seating areas. Because many spas are located outdoors, owners usually purchase covers for enclosing the spa tub when not in use. These covers help prevent dirt, leaves and other debris from entering the water. Morevoer, they can provide a safety function by preventing small children from falling into the water.

These covers are quite large, and sometimes quite heavy. They frequently are about one inch, or so, in thickness and frequently are constructed of a foam material encased in a flexible covering. Thus it is often cumbersome and difficult for a user to remove the cover prior to using the spa and to place the cover back over the spa when it is no longer in use. It would be desirable, therefore, to have an improved apparatus for the automatic removal of spa covers.

SUMMARY OF THE ILLUSTRATED EMBODIMENTS

An apparatus for lifting a cover from a spa or other housing is provided. A frame member is pivotally attached to the exterior of the housing and is further pivotally attached to the cover. A motor is likewise attached to the exterior of the housing and is pivotally coupled to the frame member. The motor causes the frame member to rotate thereby lifting the cover off of the housing.

In one aspect, the housing has a housing rim defining a housing opening. The cover has a proximate portion pivotally connected to a distal portion. A motor is disposed adjacent to the housing and is coupled to the cover by a frame member. The frame member is adapted for rotation by the motor from a first position to a second position and from a second position to a third position.

The frame member is further adapted to lift the proximate portion of the cover from the housing opening by the rotation of the frame member from the first position to the second position while the distal portion of the cover is not lifted from the housing opening. The frame member is further adapted to lift the distal portion of the cover from the housing opening by the rotation of the frame member from the second position to the third position while the proximate cover portion remains lifted from the housing opening. The proximate and distal portions of the cover are disposed on or above an imaginary plane defined by the housing rim when the frame member is in the third position.

In another aspect, the apparatus further includes a shock absorber connecting the proximate portion of the cover to the frame member. One end of the shock absorber is pivotally connected to the proximate portion of the cover and the other end is pivotally connected to the frame member.

In another aspect, the apparatus further includes control circuitry, first operator circuitry, and second operator circuitry. The control circuitry supplies electric power to the motor and controls the motor's direction of movement. The motor is adapted to move in a first direction and a second direction. The first operator circuitry supplies a first signal to the control circuitry. A first manual actuator, such as for example a push button, causes the first operator circuitry to supply the first signal to the control circuitry.

The second operator circuitry supplies a second signal to the control circuitry. A second manual actuator causes the second operator circuitry to supply the second signal to the control circuitry. The control circuitry causes the motor to move in the first direction when the control circuitry receives the first signal, but causes the motor to move in the second direction when the control circuitry receives both the first signal and the second signal.

There are additional aspects to the present inventions. It should therefore be understood that the preceding is merely a brief summary of some embodiments and aspects of the present inventions. Additional embodiments and aspects are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

BRIEF DESCRIPTION OF THE DRAWINGS

These and/or other aspects and advantages of the present invention will become apparent and more readily appreciated from the following description of certain embodiments, taken in conjunction with the accompanying drawings of which.

DETAILED DESCRIPTION

Figure 1:
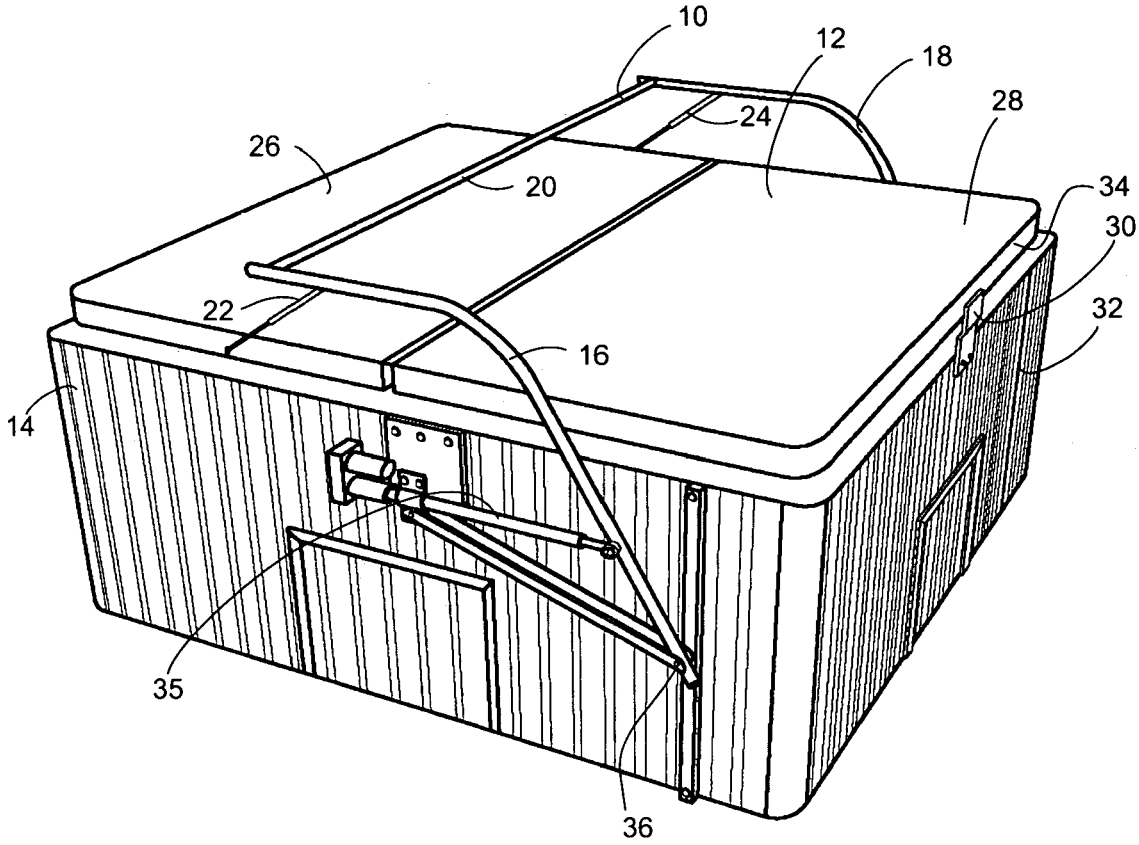
FIG. 1 is a perspective view of an apparatus for lifting a cover from a housing according to one embodiment of the invention.

The following description is of the best mode presently contemplated for carrying out the invention. Reference will be made in detail to embodiments of the present invention, examples of which are illustrated in the accompanying drawings, wherein like reference numerals refer to like elements throughout. It is understood that other embodiments may be used and structural and operational changes may be made without departing from the scope of the present invention.

Referring to FIG. 1, there is shown an apparatus 10 for lifting a cover 12 from a spa 14 in accordance with one embodiment of the invention. Shown is a first frame member 16, a second frame member 18 and a crossbar 20 extending laterally above and across the cover 12, thereby connecting the first and second frame members 16, 18. The cover 12 is constructed of foam encased within a flexible cover and has a proximate portion 26 pivotally connected to a distal portion 28.

A pair of shock absorbers 22, 24 couple the first and second frame members 16, 18 to the proximate portion 26 of the cover 12. A stop 30 is attached to a distal end 32 of the spa 14 and extends upward so that it is disposed adjacent to a distal edge 34 of the cover 12. A motor 35 is secured external to the spa 14 and is pivotally connected to the first frame member 16. One end of the first frame member 16 is pivotally connected at a frame pivot location 36 to the exterior of the spa 14. Although not shown in FIG. 1, a second motor is attached to the second frame member 18 on the opposite side of the spa 14 in the same manner as the illustrated motor 35.

As explained in further detail below, the illustrated motor 35 and the unillustrated motor push the first and second frame members 16, 18 in a direction generally toward the distal end 32 of the spa thereby rotating the first and second frame members 16, 18 about their respective frame pivot locations 36. The proximate portion 26 of the cover 12 is thereby lifted from the spa 14, followed by the distal portion 28 of the cover 12. The stop 30 prevents lateral movement of the cover distal edge 34 thereby preventing the distal portion 28 of the cover 12 from falling from the distal end 32 of the spa 14.

FIGS. 2-5 show an alternative embodiment of the invention wherein its operation can be seen in greater detail. Shown is a housing 42, such as for example a spa, having an exterior 44, an interior 46 and a rim 104 defining an-opening 98. The rim 104 further defines an imaginary plane 82 (FIG. 5) extending beyond the housing 42. The housing 42 has a housing proximate end 48 defining a proximate portion 50 of the opening 98 and a distal end 52 defining a distal portion 54 of the opening 98.

A cover 56 is adapted to fit over the opening 98 and has a proximate edge 58 adjacent to a proximate portion 60 of the cover 56 and a distal edge 62 adjacent to a distal portion 64 of the cover 56. The cover is constructed of two or more flexible foam sections encased within a flexible cover so that the proximate cover portion 60 is pivotally connected to the distal cover portion 64 at a cover connection location 102. The proximate cover portion 60 is adapted to cover the proximate portion 50 of the housing opening 98, and the distal cover portion 64 is adapted to cover the distal portion 54 of the opening 98. The cover 56 has a lower surface 78 and an upper surface 80.

A mounting assembly 86 comprised of a plurality of metal members is attached to the housing exterior 44 and is used for securing a frame member 66 and a motor 88 to the housing exterior 44. The frame member 66 has a proximate end 68 and a distal end 70. The distal end 70 is pivotally attached at a pivot location 72 to the mounting assembly 86, and the frame proximate end 68 is pivotally attached to one end of a shock absorber 74. The other end of the shock absorber 74 is pivotally attached to a cover clamp 76 which, in turn, is secured to the proximate portion 60 of the cover 56. The frame member 66 further has an arcuate-shaped portion 84 disposed between the frame proximate and distal ends 68, 70. The arcuate-shaped portion 84 is spaced-apart from and extends above the cover upper surface 80 when the cover 56 is in the fully closed position as shown in FIG. 2.

One end of a cross bar 100 is connected to the frame member 66 between its proximate and distal ends 68, 70. The cross bar 100 extends laterally across the upper surface 80 of the cover 56 and is disposed in a spaced-apart relationship above the upper cover surface 80 when the cover is in the filly closed position as shown in FIG. 2. The other end of the cross bar 100 is connected to another frame member (not shown) on the opposite side of the housing 42 and having the same arrangement as that shown in FIGS. 2-5.

Figure 2:
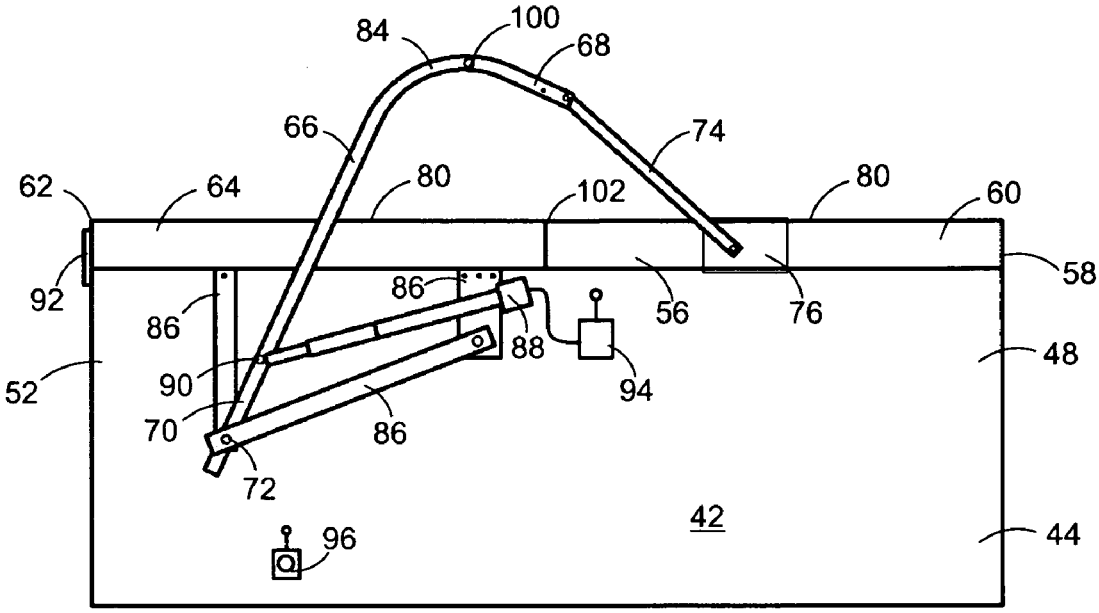
FIG. 2 is a side plan view of an apparatus for lifting a cover from a housing according to another embodiment of the invention.

As best seen in FIG. 2, when the cover is fully closed the shock absorber 74 applies a biasing force in a generally downward direction against the proximate cover portion 60 and the proximate end 48 of the housing 42, thereby providing a safety feature. Should a user of the housing or spa 42 become entrapped in the housing interior 46 when the cover 56 is in the closed position, the user can push upward on the proximate cover portion 60, and the shock absorber 74 will permit the proximate cover portion 60 to rotate upward about the cover connection location 102 so that the user can escape. (While the embodiment of FIG. 2 employs a shock absorber, other embodiments of the invention use other biasing devices, such as coils, leaf springs, clips, and other resilient members, etc. In yet other embodiments, however, no shock absorbers or other biasing devices are employed at all, although this safety feature will be lacking. Rather, the proximate end 68 of the frame member 66 is pivotally attached directly to the cover clamp 76.)

One end of a motor 88 is attached to the mounting assembly 86, and the other end of the motor 88 is pivotally attached to the frame distal end 70 at a motor attachment point 90. In this embodiment, the motor 88 is a linear drive motor. An exemplary motor can be obtained from Jaeger USA, Inc., Atlanta, Ga. as model number Harl 3624, sold under the SUPER JACK trademark. In alternative embodiments, however, other types and designs of motors may be used as well.

Figure 5:
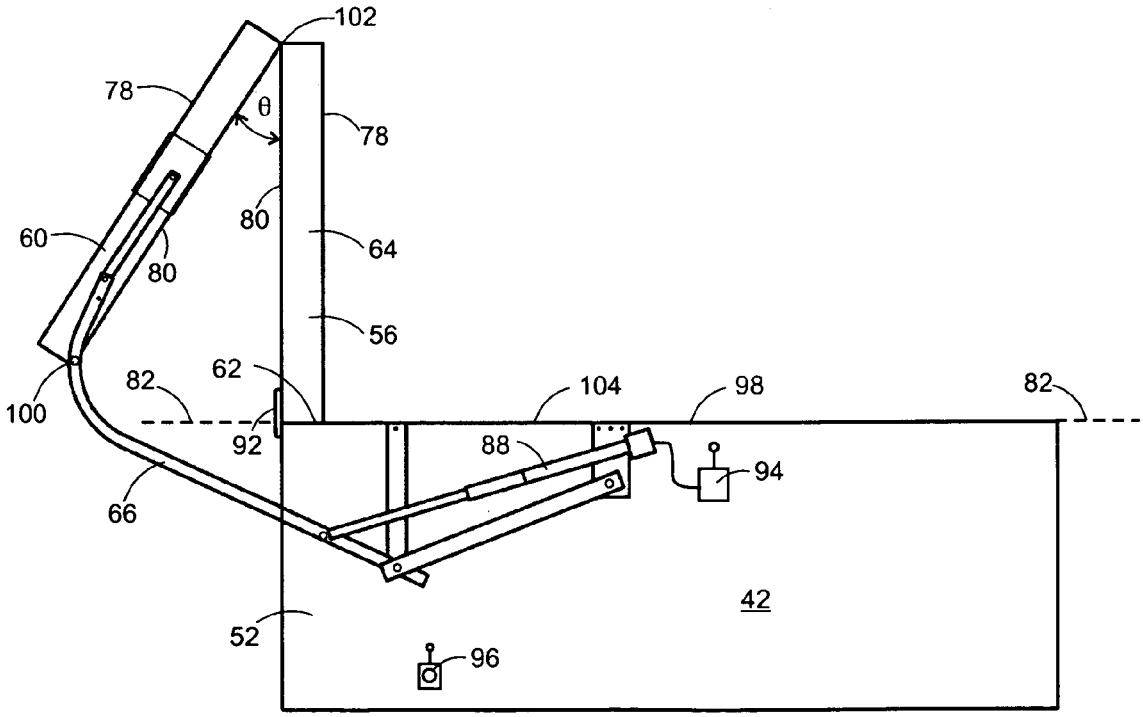
FIG. 5 is a side plan view of the apparatus of FIG. 2 with the cover fully removed from the housing.

A stop 92 is attached to the exterior 44 of the housing 42 at the distal end 52 and extends upward so that the stop 92 is disposed adjacent to the distal edge 62 of the cover 56. The stop 92 prevents the distal edge 62 of the cover 56 from moving laterally away from the housing proximate end 48 while the distal portion 64 of the cover 56 is opening and prevents the distal portion 64 from falling behind the housing distal end 52. In the illustrated embodiment, the stop 92 is a bracket member. Because the cover 56 is constructed of flexible foam encased in a flexible cover, the distal edge 62 of the cover 56 can shift and rotate as the distal cover portion 64 is being raised, and can rest against the distal end 52 of the housing 42 while the stop 92 abuts the distal portion 64 of the cover 56 when it is fully raised as best seen in FIG. 5. Alternative embodiments of the stop 92 however include a hinge so that the distal edge 62 of the cover 56 is attached to one end of the hinged stop thereby permitting the distal edge 62 to rotate with the stop 92 as the cover distal end 64 is being raised.

While FIGS. 2-5 illustrate a cover lifting apparatus as shown in a plan view of one side of the housing 42, it will be understood that the opposite side of the housing 42 includes a like arrangement, including another frame member, shock absorber, motor, mounting assembly and cover clamp.

FIGS. 2-5 show various positions of the frame member 66 and the motor 88 as the cover 56 is being lifted from the housing 42. Starting from the fully closed orientation of the cover 56 as shown in FIG. 2, the motor 88 pushes the motor attachment location 90 of the frame member 66 in a direction that is generally away from the housing proximate end 48.

Figure 3:
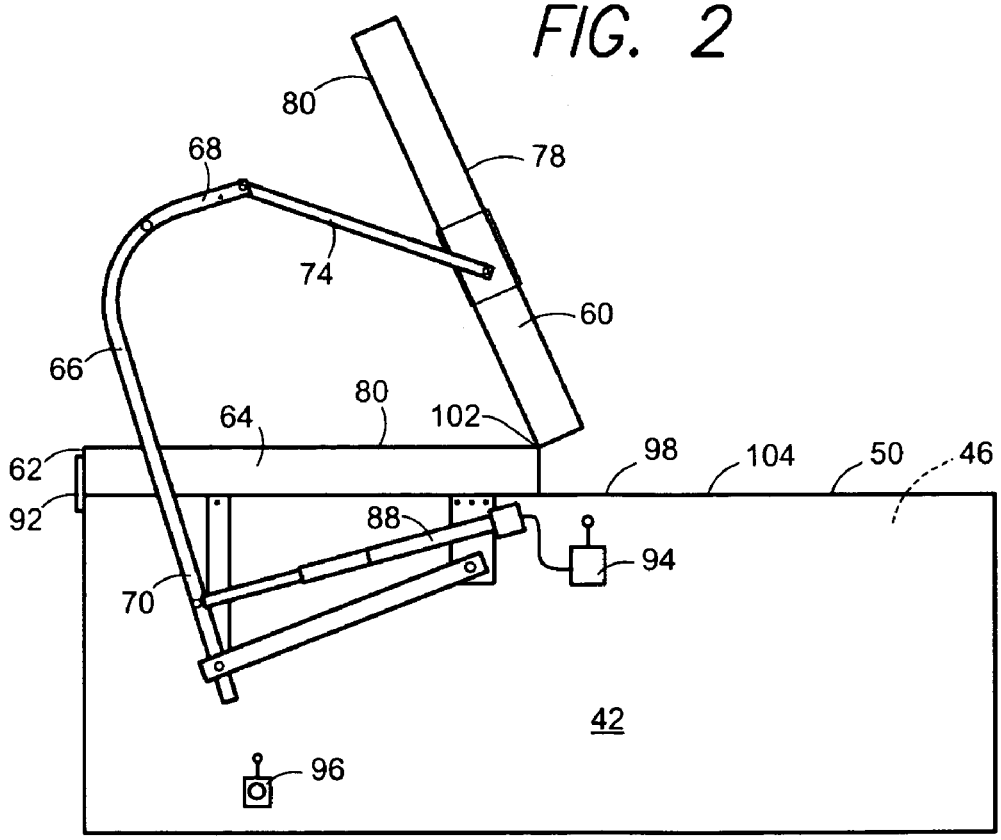
FIG. 3 is a side plan view of the apparatus of FIG. 2 with a portion of the cover lifted from the housing.

This causes the frame member 66 to rotate in a counterclockwise direction (as viewed in FIGS. 2-5) about the frame pivot location 72. As seen in FIG. 3 when the frame member 66 is rotated to a first position, the proximate cover portion 60 is rotated about the cover connection location 102 and lifted from the proximate portion 50 of the opening 98 while the distal cover portion 64 remains in a generally horizontal orientation over the distal portion 54 of the opening 98.

Figure 4:
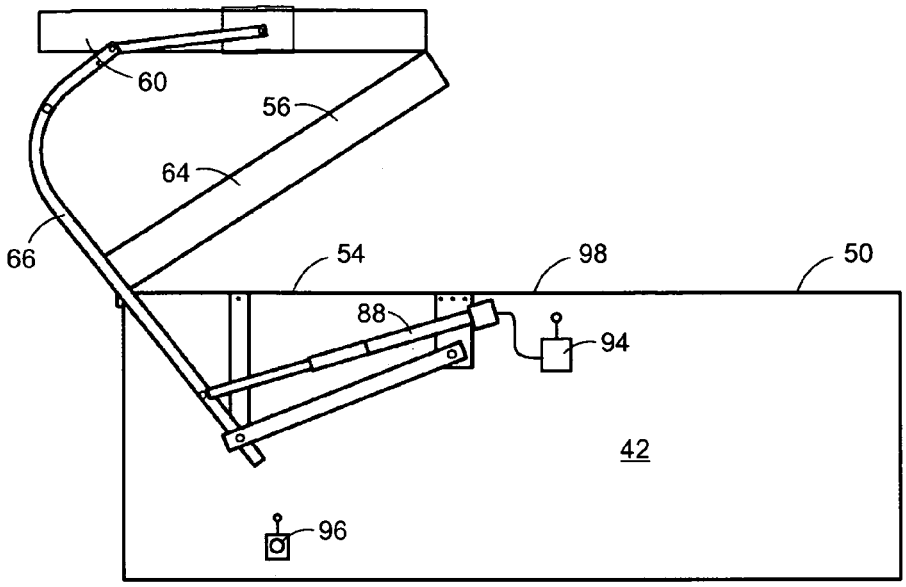
FIG. 4 is a side plan view of the apparatus of FIG. 2 with another portion of the cover lifted from the housing.

Referring now to FIG. 4, as the motor 88 continues to push the frame member 66 in a further counterclockwise direction, the distal cover portion 64 of the cover 56 is rotated and lifted from the distal portion 54 of the opening 98 while the proximate cover portion 60 remains lifted from the proximate portion 50 of the opening 98. Finally when the motor 88 has moved the frame member 66 to the furthest counterclockwise location as seen in FIG. 5, both the proximate and distal cover portions 60, 64 are fully lifted from the opening 98 and are disposed on or above the imaginary plane 82 defined by the housing rim 104. The distal cover portion 64 is in a generally vertical position, and the proximate cover portion 60 is folded back via the cover connection location 102 so that the proximate cover portion 60 rests on the cross bar 100 and so that an acute angle 0 is formed by the upper surface 80 of the cover 56. The stop 92 prevents the distal cover edge 62 from moving laterally off of the housing 42 and abuts the distal cover portion 64.

It will be appreciated that the above-described movement is reversed for returning the cover 56 over the opening 98 of the housing 42.

In order to control the supply of electrical power to the motor 88 and the motor's direction of movement, control circuitry 94 is provided. The control circuitry 94 includes receiver circuitry for receiving a first wireless signal and for supplying electrical power to the motor 88 upon receipt of the signal. A wireless transmitter (not shown) includes circuitry for the transmission of the first wireless signal upon manual actuation by a user of an actuator, such as a button, on the transmitter. Such a transmitter is similar to the wireless garage door opener transmitters that are currently in common use. Alternative embodiments however do not employ a wireless transmitter. Rather, a manual actuator, such as a button, is part of the control circuitry 94 so that a signal is sent via a wired connection.

Safety circuitry 96 is located in the vicinity of the control circuitry 94 and is in wireless communication with the control circuitry 94. The safety circuitry 96 includes a manual actuator, such as a button, that when manually actuated transmits a second wireless signal for receipt by the control circuitry 94. (In alternative embodiments, however, the connection between the safety circuitry 96 and the control circuitry 94 could be wired.)

The motor control circuitry 94 operates as follows. When the frame member 66 is in its closed orientation, as in FIG. 1, movement of the manual actuator on the wireless transmitter sends the first wireless signal to the control circuitry 94. Upon receipt of this signal, the control circuitry 94 will cause the motor 88 to move in an opening direction. When the frame member 66 is in its fully opened orientation, as in FIG. 5, movement of the manual actuator on the wireless transmitter will again send the first signal to the control circuitry 94. However at this point in time, receipt of the first signal alone will not cause the motor 88 to move in the closing direction. Rather, the second signal from the safety circuitry 96 must also be received by the control circuitry 94 which will cause the motor 88 to move in the closed direction only upon receipt of both the first and second signals.

The manual actuator portion of the safety circuitry 96 is located sufficiently far from the housing interior 46 so that a user is unable to manually reach the actuator while the user is in the housing interior 46. By requiring the user to actuate the manual safety circuitry actuator 96 (while the user is located outside of the housing interior 46) and at the same time actuate the other manual actuator on the wireless transmitter, a safety feature is provided so that the cover 56 is not likely to close on the user while the user is in the housing interior 46.

Thus FIGS. 2-5 further illustrate a method of lifting the cover 56 from the housing 42. The proximate cover portion 60 of the cover 56 is lifted from a generally horizontal orientation over the proximate portion 50 of the opening 98 using the motor 88 coupled to the frame member 66, which in turn is coupled to the cover 56. The distal portion 64 of the cover 56 remains in a generally horizontal orientation over the distal portion 54 of the opening 98 while the proximate cover portion 60 is being lifted due to the pivotal connection between the proximate and distal cover portions 60, 64.

Then the distal cover portion 64 of the cover 56 is lifted from its generally horizontal orientation over the distal portion 54 of the opening 98 using the motor 88 and the frame member 66. The proximate cover portion 60 no longer covers the proximate portion 50 of the opening 98 while the distal cover portion 64 is being lifted. The distal edge 62 of the cover 56 is prevented from moving laterally away from the housing proximate end 48 while the distal portion 64 of the cover 56 is being lifted from the opening 98.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. An apparatus in combination with a conventional cover and a housing for lifting the cover off of the housing; the housing having a housing rim defining a housing opening and further defining an imaginary plane extending beyond the housing, wherein the cover has a proximate portion of the cover pivotally connected to a distal portion of the cover, the apparatus comprising:

a motor coupled to a side of the housing;

a frame member movably coupled to the motor;

a biasing device pivotally coupled with the proximate portion of the cover and with the frame member;

wherein the frame member is movable by the motor from a first position to a second position and from a second position to a third position, wherein movement of the frame member by the motor lifts the proximate portion of the cover with the biasing device from the housing rim by the movement of the frame member from the first position to the second position while the distal portion of the cover is not lifted from the housing rim, wherein the frame member when moved by the motor lifts both simultaneously the distal portion and proximate portion of the cover from the housing rim from the second position to the third position, and wherein the entire proximate portion of the cover and the entire distal portion of the cover are disposed on or above the imaginary plane defined by the housing rim when the frame member is in the third position.

2. The apparatus of claim 1 wherein the biasing device biases the proximate portion of the cover in a generally downward direction against the housing rim when the frame member is in the first position.

3. The apparatus of claim 2 wherein the biasing device is a shock absorber.

4. The apparatus of claim 1, further comprising:

control circuitry for supplying electric power to the motor and for controlling the movement of the frame member by the motor;

first operator circuitry for supplying a first signal to the control circuitry;

a first manual actuator for causing the first operator circuitry to supply the first signal to the control circuitry;

second operator circuitry for supplying a second signal to the control circuitry; and a second manual actuator for causing the second operator circuitry to supply the second signal to the control circuitry, wherein the control circuitry causes the motor to move the frame member in a first direction when the control circuitry receives the first signal, and wherein the control circuitry causes the motor to move the frame member in a second direction when the control circuitry receives both the first signal and the second signal.

5. The apparatus of claim 4 wherein the first operator circuitry includes circuitry for the wireless transmission of the first signal, and wherein the control circuitry includes circuitry for the wireless receipt of the first signal.

6. The apparatus of claim 5 wherein the second operator circuitry includes circuitry for the wireless transmission of the second signal, and wherein the control circuitry includes circuitry for the wireless receipt of the second signal.

7. The apparatus of claim 1 wherein the housing is a spa.

8. The apparatus of claim 1 wherein the frame member includes;

a distal portion movably coupled with the motor;

a proximate portion of the frame member movably coupled with the biasing device; and, an integral arcuate-shaped portion disposed between the proximate portion and the distal portion.

9. The apparatus of claim 8 wherein the integral arcuate-shaped portion extends above the cover when the frame member is in the first position.

10. The apparatus of claim 1 wherein the motor moves the frame member such that the proximate portion of the cover is pivotally moved with the biasing device toward the distal portion of the cover when the frame member is moved from the first position to the second position.

11. The apparatus of claim 1 further comprising:

a second frame member disposed on an opposite side of the housing from the motor;

a second motor coupled to the second frame member for moving the second frame member in unison with the first frame member;

a cross frame member which extends across the cover and connects the frame member with the second frame member such that the frame member and the second frame member move in unison when moved by the motor and second motor; and, wherein the second frame member is pivotally connected to the proximate portion of the cover with a second biasing device.

12. An apparatus in combination with a conventional cover and a spa for lifting the cover off of the spa, the spa having a rim comprising:

a first frame member having a first frame member proximate end and a first frame member distal end, wherein the first frame member distal end is pivotally attached at a frame pivot location to an exterior of the spa, and wherein the first frame member proximate end is pivotally coupled to a shock absorber that is pivotally coupled with a proximate cover portion of the cover;

a stop attached to the exterior of the spa for preventing a generally lateral movement of a cover distal edge in a direction generally away from a proximate end of the spa; and a motor coupled to the first frame member for moving the first frame member about the frame pivot location from a frame first position to a frame second position, and from the frame second position to a frame third position, wherein the cover is disposed in a generally horizontal orientation over a top of the spa when the first frame member is in the frame first position, wherein movement of the first frame member causes the proximate cover portion to be lifted with the shock absorber from the proximate end of the spa while a distal cover portion remains disposed in the generally horizontal orientation over a distal end of the spa when the first frame member is moved from the frame first position to the frame second position, and wherein further movement of the first frame member causes the proximate cover portion to be lifted with the shock absorber from the proximate end of the spa and the distal cover portion also to be lifted from the distal end of the spa when the first frame member is moved from the frame second position to the frame third position, wherein the entire proximate portion of the cover and the entire distal portion of the cover are disposed on or above an imaginary plane defined by the spa rim when the first frame member is in the frame third position.

13. The apparatus of claim 12 wherein the first frame member has an integral arcuate-shaped portion disposed between the first frame member proximate end and the first frame member distal end, and wherein the arcuate-shaped portion extends above the cover when the first frame member is in the frame first position.

14. The apparatus of claim 12 wherein the motor is pivotally attached to the first frame member distal end at a motor attachment location on the first frame member distal end, and wherein the motor moves the motor attachment location of the first frame member in a direction generally away from the proximate end of the spa when the first frame member is moved from the frame first position to the frame second position.

15. An apparatus in combination with a conventional cover and a spa for lifting the cover from the spa, the spa having a rim comprising:

a first motor attached to a side of the spa;

a second motor disposed on an opposite side of the spa and arranged in a same manner as the first motor;

a first frame member having a proximate portion movably coupled to the first motor, an integral arcuate portion which extends above the cover when the cover is horizontally disposed on the spa and a distal portion pivotally attached to the cover with a shock absorber;

a second frame member having a proximate portion movably coupled to the second motor, an integral arcuate portion which extends above the cover when the cover is horizontally disposed on the spa and a distal portion pivotally attached to the cover with a second shock absorber;

a cross bar which extends laterally across the spa and connects the first and second frame members together such that the first and second frame members move in general unison when moved with the first and second motors; and, a vertical stop affixed to one end of the spa for preventing the cover from moving horizontally beyond the one end of the spa wherein the cover is, disposed in a generally horizontal orientation over a top of the spa when the first frame member is in a first position, wherein movement of the first frame member causes a proximate portion of the cover to be lifted with the shock absorber from a proximate end of the spa while a distal portion of the cover remains disposed in the generally horizontal orientation over a distal end of the spa when the first frame member is moved from the first position to a second position, wherein further movement of the first frame member causes the proximate cover portion to be lifted with the shock absorber from the proximate end of the spa and the distal cover portion also to be lifted from the distal end of the spa when the first frame member is moved from the second position to a third position, wherein the entire proximate portion of the cover and the entire distal portion of the cover are disposed on or above an imaginary plane defined by the spa rim when the first frame member is in the third position.

16. The apparatus of claim 15 further comprising means for energizing the first and second motors with a wireless signal.

17. The apparatus of claim 15 further comprising:

electrical circuitry;

a first manual actuator coupled to the electrical circuitry; and a second manual actuator coupled to the electrical circuitry, wherein the electrical circuitry energizes the first and second motors for movement of the cover in a first direction in response to actuation of the first manual actuator, and wherein the motor circuitry energizes the first and second motors for movement of the cover in a second direction in response to actuation of both the first manual actuator and the second manual actuator.

* * * * *